US008864395B2

(12) United States Patent
Yamanaka

(10) Patent No.: US 8,864,395 B2
(45) Date of Patent: Oct. 21, 2014

(54) MEDIUM FEEDING APPARATUS WITH ADJUSTABLE EDGE GUIDE

(75) Inventor: Tsuyoshi Yamanaka, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 351 days.

(21) Appl. No.: 12/943,582

(22) Filed: Nov. 10, 2010

(65) Prior Publication Data

US 2011/0110698 A1 May 12, 2011

(30) Foreign Application Priority Data

Nov. 12, 2009 (JP) ..... 2009-259106

(51) Int. Cl.

| | |
|---|---|
| ***B41J 13/30*** | (2006.01) |
| ***B65H 5/26*** | (2006.01) |
| ***B65H 5/38*** | (2006.01) |
| ***B41J 13/10*** | (2006.01) |
| ***B41J 13/14*** | (2006.01) |

(52) U.S. Cl.

CPC ..... *B65H 5/26* (2013.01); *B65H 2801/12* (2013.01); *B65H 2511/21* (2013.01); *B65H 2701/1315* (2013.01); *B65H 5/38* (2013.01); *B41J 13/103* (2013.01); *B65H 2301/14* (2013.01); *B41J 13/14* (2013.01)

USPC ..... 400/633.2; 400/633; 271/241; 271/248

(58) Field of Classification Search

CPC ..... B41J 13/30; B65H 9/10; B65H 9/101; B65H 29/52

USPC ..... 271/248, 249, 250, 251, 241; 399/395, 399/405, 393; 400/578, 579, 619, 630, 633, 400/633.2, 646, 633.1

See application file for complete search history.

(56) References Cited

U.S. PATENT DOCUMENTS

| | | | | |
|---|---|---|---|---|
| 5,080,345 | A * | 1/1992 | Daniels | 271/239 |
| 6,688,592 | B1 * | 2/2004 | Tan et al. | 271/171 |
| 6,893,015 | B2 * | 5/2005 | Tan et al. | 271/171 |
| 7,404,557 | B2 * | 7/2008 | Tada et al. | 271/226 |

FOREIGN PATENT DOCUMENTS

| | | |
|---|---|---|
| JP | 2007-223789 | 9/2007 |

* cited by examiner

*Primary Examiner* — Daniel J Colilla
*Assistant Examiner* — Justin Olamit
(74) *Attorney, Agent, or Firm* — Workman Nydegger

(57) ABSTRACT

A medium feeding apparatus includes: a placement portion on which a medium is placed; a feeding unit which feeds the fed medium placed on the placement portion in a feeding direction; an edge guide which makes contact with the medium placed on the placement portion at a side edge in a width direction so as to determine a position of the medium in the width direction; and an adjustment unit which displaces at least a part of the edge guide such that a contact portion of the edge guide with the medium is placed on a line along the feeding direction so as to adjust a posture of the medium with respect to the feeding direction.

4 Claims, 11 Drawing Sheets

MEDIUM FEEDING APPARATUS WITH ADJUSTABLE EDGE GUIDE

BACKGROUND

1. Technical Field

The present invention relates to a medium feeding apparatus including a placement portion on which a fed medium is placed, a feeding unit which feeds the fed medium placed on the placement portion in the feeding direction, and an edge guide which makes contact with the fed medium placed on the placement portion at a side edge in the width direction so as to determine a position of the fed medium in the width direction, and a recording apparatus including the medium feeding apparatus.

In the application, the recording apparatus includes various types of apparatuses such as an ink jet printer, a wire dot printer, a laser printer, a line printer, a copying machine, and a facsimile machine.

2. Related Art

In an existing technique, a printer as an example of a recording apparatus has a feeding portion as a medium feeding apparatus as described in JP-A-2007-223789. In the technique, the feeding portion has a hopper as a placement portion, an edge guide, and a feeding roller as a feeding unit. The hopper is provided such that a paper as an example of a medium is placed on the hopper. The edge guide is configured to be in contact with the placed paper at a side edge so as to determine a position and a posture of the paper in the width direction. Further, the feeding roller is configured so as to feed the placed paper in the feeding direction.

However, there arises a risk that a posture of a guide surface of the edge guide, which makes contact with the paper at the side edge, is not perpendicular to the feeding roller depending on an assembly accuracy of the apparatus if the configuration of the feeding portion becomes complicated. That is to say, a risk that the posture of the guide surface is inclined with respect to the feeding direction is caused. Accordingly, there arises a risk that the posture of the paper has already inclined when the paper is started to be fed and the inclination of the paper becomes larger as the paper is fed.

SUMMARY

An advantage of some aspects of the invention is to provide a medium feeding apparatus in consideration of a posture of a medium to be fed with respect to the feeding direction of the medium and a recording apparatus including the medium feeding apparatus.

A medium feeding apparatus according to a first aspect of the invention includes a placement portion on which a fed medium is placed, a feeding unit which feeds the fed medium placed on the placement portion in the feeding direction, an edge guide which makes contact with the fed medium placed on the placement portion at a side edge in the width direction so as to determine a position of the fed medium in the width direction, and an adjustment unit which displaces at least a part of the edge guide such that a contact portion of the edge guide with the fed medium is placed on a line along the feeding direction so as to adjust a posture of the fed medium with respect to the feeding direction.

According to the first aspect of the invention, the medium feeding apparatus can be made into a state where the posture of the fed medium is hardly inclined with respect to the feeding direction by the adjustment unit. That is, a so-called skew, which is inclination of the posture of the fed medium with respect to the feeding direction, can be reduced. Further, production tolerance generated when shapes of parts such as the placement portion and the edge guide in the medium feeding apparatus become complicated or the number of the parts is increased can be reduced.

The direction in which the adjustment unit displaces at least a part of the edge guide is as follows. That is, it is sufficient that a portion of the edge guide which makes contact with a side edge of the medium is displaced in an approaching/receding direction with respect to the side edge of the medium. In other words, the edge guide itself may be displaced arbitrarily in either direction.

For example, the contact portion is an inclined surface and is gradually inclined upward to the face side in a face-reverse direction of the medium toward the outer side in the width direction. In such a case, the contact portion can be displaced in the width direction by displacing the guide portion in the front-back direction. This makes it possible to adjust the posture of the medium.

According to a second aspect of the invention, in the first aspect of the invention, the adjustment unit is configured such that at least one of an upstream side and a downstream side of the edge guide in the feeding direction is capable of swinging about the other of the upstream side and the downstream side as a fulcrum in the width direction which is the approaching/receding direction with respect to the side edge of the fed medium.

According to the second aspect of the invention, the following operation effect is obtained in addition to the same operation effect as that of the first aspect. That is, the adjustment unit can easily adjust the posture of the fed medium with respect to the feeding direction by displacing the posture of the edge guide with respect to the feeding direction.

According to a third aspect of the invention, in the first aspect of the invention, the edge guide includes a first guide portion which makes contact with the side edge of the fed medium, and a second guide portion which is provided at a position different from that of the first guide portion in the feeding direction and makes contact with the side edge of the fed medium, and the adjustment unit is configured such that the second guide portion is relatively displaced with respect to the first guide portion by displacing the second guide portion in the width direction which is an approaching/receding direction with respect to the side edge of the fed medium.

According to the third aspect of the invention, the following operation effect is obtained in addition to the same operation effect as that of the first aspect. That is, the adjustment unit can easily adjust the posture of the fed medium with respect to the feeding direction by relatively displacing the second guide portion with respect to the first guide portion. That is, the adjustment unit moves a part of the edge guide so as to approach to or recede from the side edge of the fed medium in the width direction. Then, the posture of the fed medium can be adjusted by relatively displacing the part of the edge guide with respect to another portion in the width direction without changing the posture of the entire edge guide.

According to a fourth aspect of the invention, in any one of the first through third aspects of the invention, the adjustment unit includes an eccentric cam, and a cam follower which abuts against the eccentric cam, and the cam follower is provided on the edge guide.

According to the fourth aspect of the invention, the following operation effect is obtained in addition to the same operation effect as that of any one of the first through third aspects. That is, the adjustment unit can be configured more easily. Further, the posture of the fed medium can be finely adjusted by the eccentric cam. As a result, the accuracy of the posture of the fed medium with respect to the feeding direction can be improved.

A recording apparatus according to a fifth aspect of the invention includes a medium feeding unit which feeds a recording medium to a downstream side in the feeding direction, and a recording portion which records onto the recording medium fed by the medium feeding unit by a recording head. In the recording apparatus, the medium feeding unit includes the medium feeding apparatus according to any one of the first through fourth aspects of the invention, and the recording medium is the fed medium.

According to the fifth aspect of the invention, the medium feeding unit includes the medium feeding apparatus according to any one of the first through fourth aspects of the invention. Accordingly, the same operation effect as that of any one of the first through fourth aspects can be obtained with the recording apparatus.

According to a sixth aspect of the invention, in the fifth aspect of the invention, the feeding unit is a feeding roller pair including a feeding driving roller which drives with a driving force of a motor, and a feeding driven roller which rotates following the feeding driving roller; the feeding roller pair is provided so as to be switchable between a first state where the feeding driving roller and the feeding driven roller approach to each other and a second state where the feeding driving roller and the feeding driven roller recede from each other; when the recording medium is placed, the feeding roller pair is in the second state, and the feeding roller pair is switched to the first state by a direction to execute recording so as to nip the recording medium; the feeding roller pair feeds the recording medium to the recording portion while keeping a state where the feeding roller pair nips the recording medium; and the recording portion executes recording onto the recording medium which is being nipped by the feeding roller pair.

According to the sixth aspect of the invention, the following operation effect is obtained in addition to the same operation effect as that of the fifth aspect. That is, the recording portion executes recording onto the recording medium while keeping a state where the feeding roller pair nips the recording medium. Namely, skew removal operation cannot be executed with the configuration. The adjustment unit is particularly effective for a configuration in which the skew removal operation is not executed and cannot be executed.

The expression "skew removal" is adjustment of the inclined posture of a recording medium with respect to the feeding direction. Further, the expression "skew removal operation" indicates an operation for adjusting the posture of the recording medium. The skew removal operation includes a so-called "bite and discharge method" and "push and abut method."

The "bite and discharge method" is a method as follows. That is, a second roller pair provided at the downstream side with respect to a first roller pair nips a tip of the recording medium once. Then, the second roller pair is reversely rotated so as to reversely feed the tip of the recording medium to the upstream side in the feeding direction. Thereafter, the recording medium is made to bow between the first roller pair and the second roller pair and the tip of the recording medium is pushed to a nip line of the second roller pair. With this, the posture of the tip of the recording medium is made to be along the nip line.

The "nip line" indicates a line formed by a portion where the roller pair is circumscribed. That is, the "nip line" is a line formed by a portion where the roller pair nips the recording medium in a pressurized manner.

That is to say, after the tip of the recording medium is made to be bitten by the second roller pair once, the tip of the recording medium is discharged to the upstream side in the feeding direction so as to make the recording medium bow and make the posture of the tip thereof be along the nip line.

On the other hand, the "push and abut method" is a method as follows. That is, the recording medium is fed to the downstream side in the feeding direction by the first roller pair. Then, the tip of the recording medium is pushed to the nip line of the second roller pair in a state where the second roller pair stops or reversely drives. With this, the posture of the tip of the recording medium is made to be along the nip line. That is, the "push and abut method" is a method in which the tip of the recording medium is pushed to the second roller pair so as to make the posture of the tip of the recording medium be along the nip line. It is to be noted that the recording medium may be made to bow between the first roller pair and the second roller pair to make the posture of the tip thereof be along the nip line. Alternatively, the recording medium may not be made to bow therebetween to make the posture of the tip thereof be along the nip line.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings.

Figure 1:
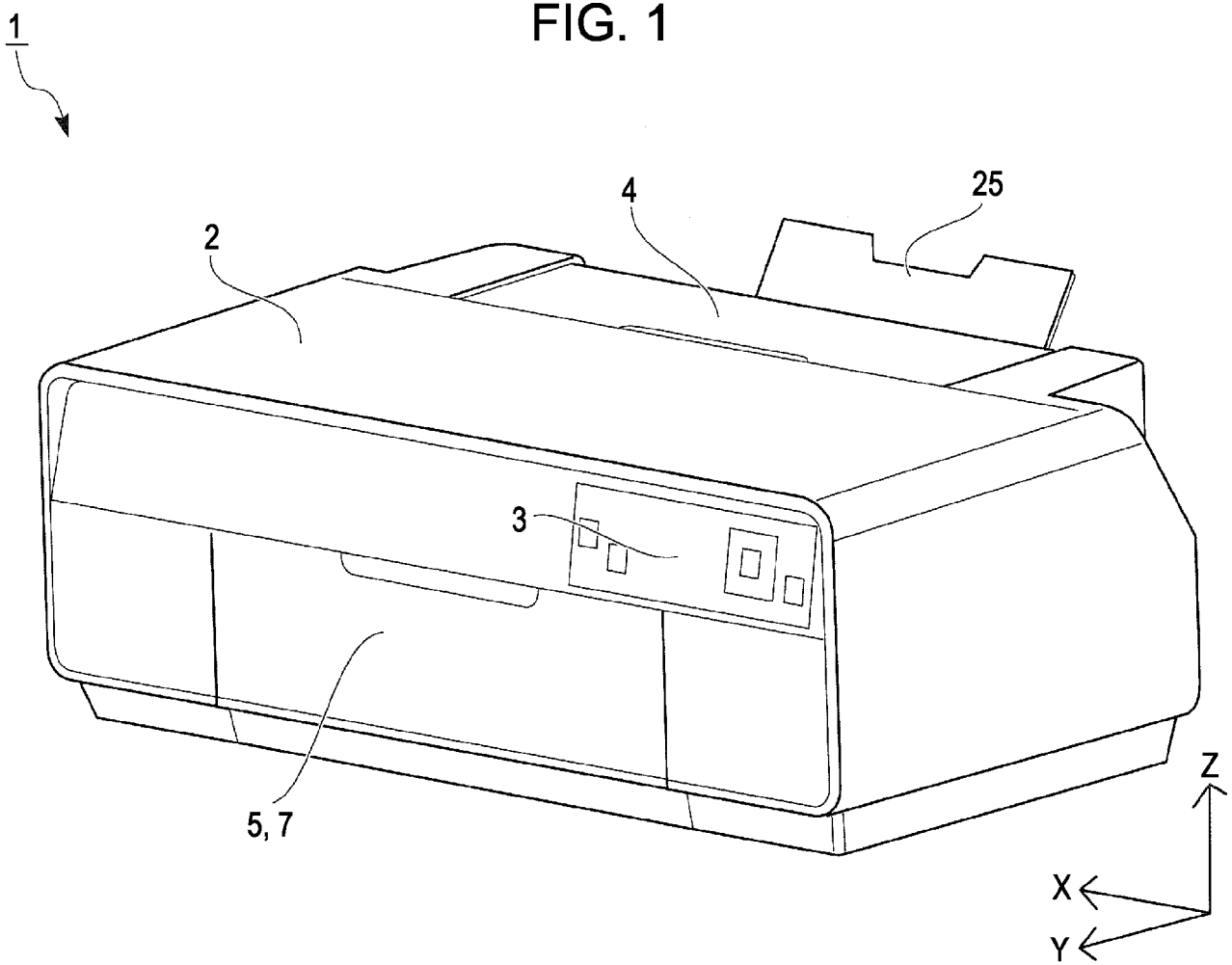
FIG. 1 is a perspective view illustrating an entire printer according to the invention (in a state where a second cover member is closed).

FIG. 1 is a perspective view illustrating an inkjet printer (hereinafter, referred to as "printer") 1 in a state where a second cover member (first tray) which will be described later is closed. The ink jet printer 1 is as an example of a "recording apparatus" or "liquid ejecting apparatus." FIG. 2 is a perspective view illustrating the printer in a state where the second cover member (first tray) of the printer is opened to a front side of the printer and a second tray which will be described later protrudes to the front side of the printer.

The liquid ejecting apparatus is not limited to an ink jet recording apparatus and a recording apparatus such as a copying machine and a facsimile machine, which execute recording onto a recording medium such as a recording paper by ejecting ink onto the recording medium from a recording head as a liquid ejecting head. As the liquid ejecting apparatus, the following apparatus is further cited. In the apparatus, instead of ink, liquid which can be used for a specific application is ejected onto an ejection target member corresponding to the recording medium from a liquid ejecting head corresponding to the recording head so as to make the liquid adhere to the ejection target member.

Further, as the liquid ejecting head, the following heads are cited in addition to the above-described recording head. That is, a color material ejecting head used for manufacturing a color filter of a device such as a liquid crystal display, an electrode material (conductive paste) ejecting head used for forming an electrode of a device such as an organic EL display or a surface light emission display (FED), a bioorganic compound ejecting head used for manufacturing a biochip, a specimen ejecting head which ejects a specimen as a precise pipette, and the like are cited.

Figure 2:
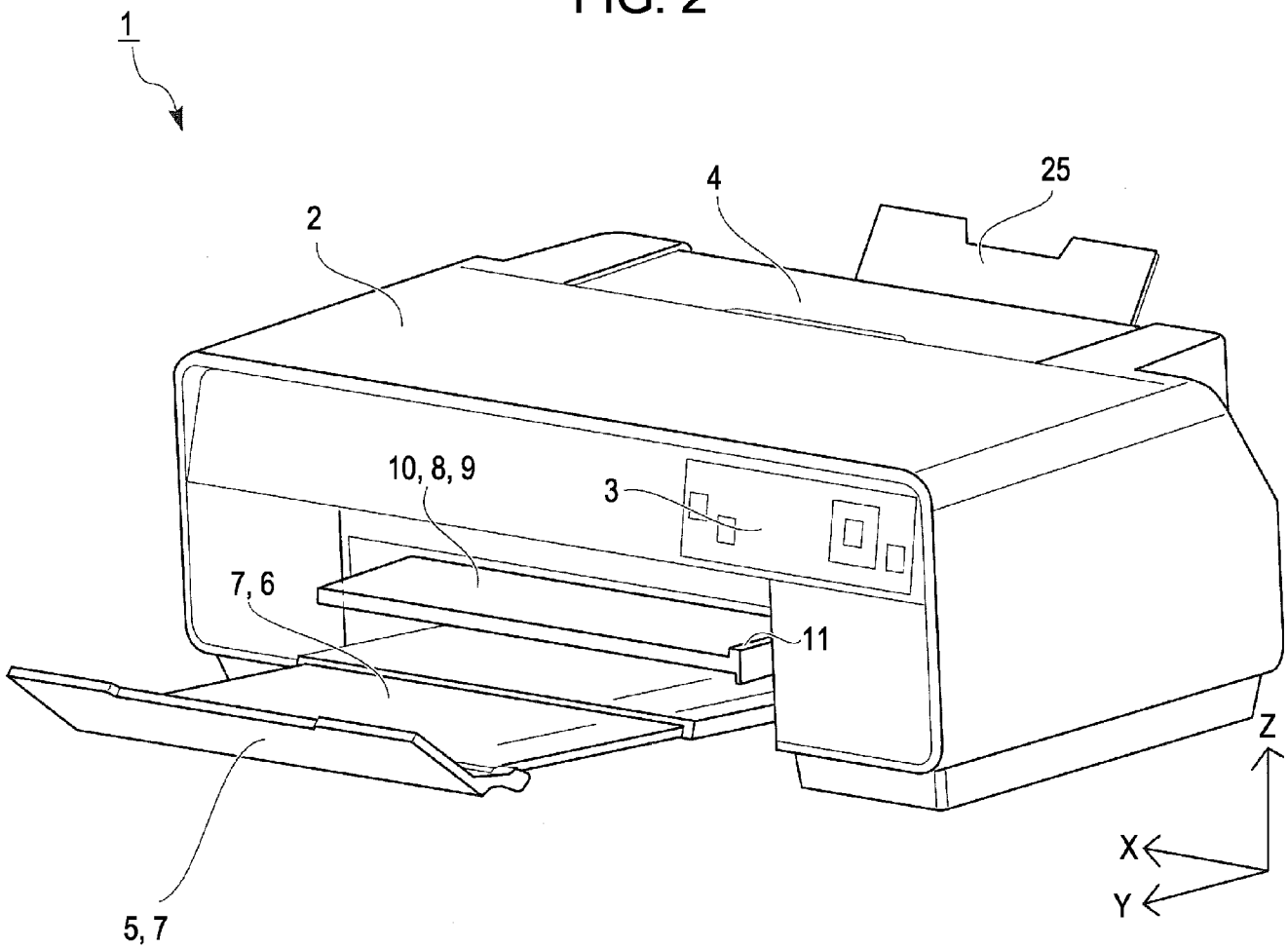
FIG. 2 is a perspective view illustrating the entire printer according to the invention (in a state where the second cover member is opened).

As shown in FIG. 1 and FIG. 2, the printer 1 has a housing 2. Further, the printer 1 has a medium feeding apparatus 42 which will be described later (see, FIG. 3 through FIG. 6) in the housing 2. A first cover member 4 is provided on an upper portion of the printer 1 in the vertical direction. The first cover member 4 as shown in FIG. 1 and FIG. 2 is closed. If the first cover member 4 is opened to an upper side, a user can set a plain paper P1 on a hopper 23. The plain paper P1 is an example of a first-class medium. The hopper 23 serves as a first placement portion 22 which will be described later (see, FIG. 3 through FIG. 6).

The expression "first-class medium" indicates a medium which can be fed on a first feeding path (R1 (see, FIG. 3)) by a feeding roller 27 as a first feeding unit 26 (see, FIG. 3 through FIG. 6) as will be described later. To be more specific, the "first-class medium" has flexibility and can be fed by the first feeding unit 26 (see, FIG. 3 through FIG. 6). The first feeding unit 26 applies a feeding force smaller than that by a second feeding unit 35 which will be described later (see, FIG. 3 through FIG. 6) to the medium. Further, the "first-class medium" is a medium which is fed one by one in a state where a plurality of media are laminated on the first placement portion 22 (see, FIG. 3 through FIG. 6). The expression "plain paper" indicates a paper of which weight is approximately 60 to 90 g/m$^2$ and which is commonly used. It is needless to say that the "plain paper" may be a paper beyond the above range.

Further, an operation portion 3 having buttons and the like is provided at a front portion of the printer 1. A user operates the operation portion 3 so as to set conditions of a medium such as a recording condition and a paper, and the like. Further, a signal directing to start recording is sent to a controller (not shown) by operating the operation portion 3. In addition, a second cover member 5 is provided at the front portion of the printer 1. FIG. 1 shows a state where the second cover member 5 is closed.

On the other hand, FIG. 2 shows a state where the second cover member 5 is opened. When the second cover member 5 is opened and made into a state where the second cover member 5 is slidingly extended, the second cover member 5 serves as a first tray 7 as a first discharge portion 6. At this time, the second cover member 5 is slidingly extended such that an inner portion of the second cover member 5 is drawn. The plain paper P1 is discharged from the first discharge portion 6. Further, if the second cover member 5 is opened, a second tray 10 in the printer 1 can protrude to the front side of the printer 1. In the state where the second tray 10 protrudes, the second tray 10 serves as a second placement portion 8 on which a board paper or a CD-R tray P2 and a dedicated paper P3 can be placed. The board paper and the CD-R tray are thick media as will be described later and are examples of a second-class medium. The dedicated paper P3 is a thick medium as will be described later and is an example of a third-class medium.

The expression "second-class medium" indicates a medium which cannot be fed through the first feeding path (R1) by the first feeding unit 26 as will be described later. To be more specific, the "second-class medium" is a medium which does not have flexibility and has high rigidity or a medium which has high elasticity even if the medium has flexibility. Further, the expression "board paper" indicates a panel (board) integrated with a medium.

The expression "third-class medium" indicates a medium which cannot be fed through the first feeding path (R1) by the first feeding unit 26 like the "second-class medium." To be more specific, the "third-class medium" is a medium which has flexibility and has small elasticity in comparison with that of the "second-class medium." Further, the "dedicated paper" indicates a paper used for a specific purpose such as a photograph unlike the plain paper P1. The "dedicated paper" has high elasticity in comparison with that of the plain paper P1.

Further, the second tray 10 also serves as a second discharge portion 9. The board paper or the CD-R tray P2 and the dedicated paper P3 on which recording has completed are discharged from the second discharge portion 9.

A movable guide member 25 is provided at a rear portion of the printer 1. FIG. 2 shows a state where the movable guide member 25 is opened to the rear side. To be more specific, FIG. 2 shows a state where the movable guide member 25 is opened and is slidingly extended upward such that an inner portion of the movable guide member 25 is drawn. If the movable guide member 25 is made into the opened state when recording is executed onto the dedicated paper P3, a medium feeding path (R3) is bent when seen from the side, as will be described later in detail (see, FIG. 5).

In the Case of Plain Paper (First-Class Medium)

Next, an inner portion of the printer 1 is described.

Figure 3:
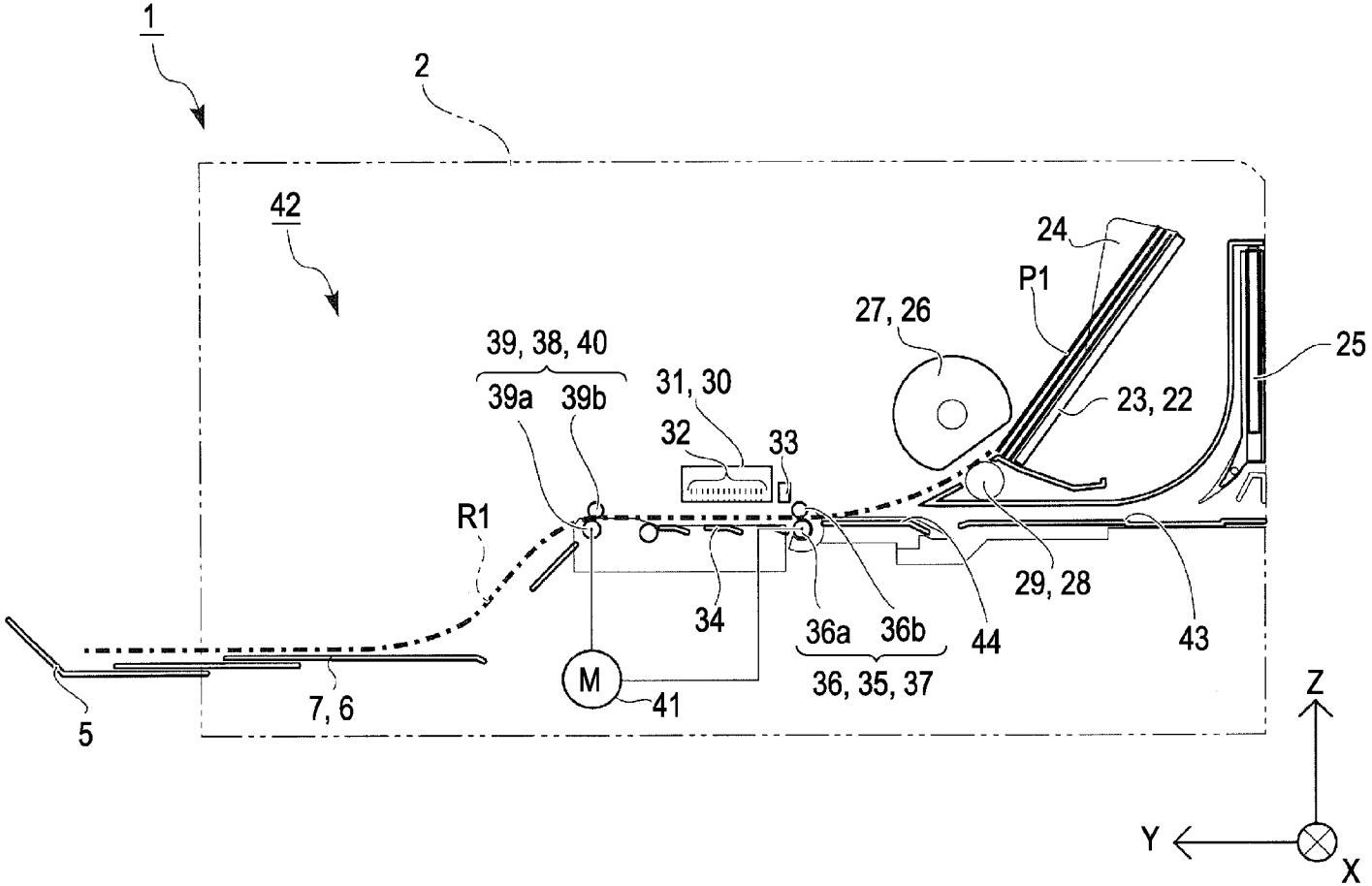
FIG. 3 is a schematic side view illustrating an inner portion of the printer according to the invention (when a first-class medium is transported).

FIG. 3 is a schematic side view illustrating an inner portion of the printer 1 when the plain paper (first-class medium) is transported and recording is executed onto the plain paper.

As shown in FIG. 3, the printer 1 includes the medium feeding apparatus 42 which feeds a medium and a recording portion 30. Further, the medium feeding apparatus 42 includes the first placement portion 22, the first feeding unit 26, a separation unit 28, the second feeding unit 35, the recording portion 30, a third feeding unit 38, and the first discharge portion 6. The first placement portion 22 is provided such that the plain paper P1 can be placed thereon. To be more specific, the first placement portion 22 has the hopper 23, and first edge guides 24.

The hopper 23 is provided so as to move to approach to or recede from the feeding roller 27 which will be described later in a state where the hopper 23 is integrated with the placed plain paper P1. The first edge guides 24 are provided in a pair so as to move to approach to or recede from the feeding roller 27 in a state where the first edge guides 24 are integrated with the hopper 23. Further, the first edge guides 24 are provided so as to move on the hopper in a width direction X at both sides of the plain paper P1.

Accordingly, both side edges of the plain paper P1 placed on the hopper can be aligned neatly. Further, the plain paper P1 in the width direction X can be positioned on the hopper with high accuracy.

The first feeding unit 26 is provided so as to feed the plain paper P1 on the hopper to the downstream side in the feeding direction. To be more specific, the first feeding unit 26 has a feeding roller 27 which drives by a first motor (not shown).

The first feeding unit 26 is provided so as to feed an uppermost plain paper P1 to the downstream side in the feeding direction with a friction force generated when the uppermost plain paper P1 on the hopper is made into contact with the feeding roller 27.

In the embodiment, a configuration in which the hopper 23 which also serves as the first placement portion 22 moves to approach to or recede from the feeding roller 27 is employed. However, the configuration is not limited thereto. It is sufficient that the hopper 23 and the feeding roller 27 relatively move to approach to or recede from each other. In other words, it is needless to say that a configuration in which the feeding roller 27 moves to approach to or recede from the hopper 23 may be employed.

Further, the separation unit 28 is provided such that the second and subsequent plain papers P1 which are unnecessary at this time can be separated from the uppermost plain paper P1 when a plurality of plain papers P1 to be fed by the first feeding unit 26 are laminated. To be more specific, the separation unit 28 has a so-caller retard roller 29 as an example. The retard roller 29 is a roller which rotates with a predetermined load and has been commonly known.

It is to be noted that the separation unit 28 may be a pad made of a material having a high friction coefficient.

A tip of the uppermost plain paper P1 is guided to the second feeding unit 35 by a second guide portion 44. The second guide portion 44 is provided at the downstream side with respect to the first guide portion 43 in the feeding direction at the time of the recording (the direction shown by an arrow of Y-axis). The first guide portion 43 is configured to guide a medium when the medium is the dedicated paper P3 or the board paper, the CD-R tray or the like P2 as will be described later.

On the other hand, the second feeding unit 35 is configured to further feed the plain paper P1 fed by the first feeding unit 26 to the recording portion 30 at the downstream side in the feeding direction when the medium is the plain paper P1.

As will be described later in detail, the second feeding unit 35 is configured to feed a medium to the upstream side or the downstream side in the feeding direction at the time of the recording when the medium is the dedicated paper P3, or the board paper, the CD-R tray or the like P2.

To be more specific, the second feeding unit 35 has a first roller pair 36. The first roller pair 36 includes a first driving roller 36*a* which drives with a driving force of a second motor 41 and a first driven roller 36*b* which rotates following the first driving roller 36*a*. Further, the second feeding unit 35 is configured such that the first driving roller 36*a* and the first driven roller 36*b* relatively move to approach to or recede from each other by a first approaching/receding unit 37 as will be described later in detail. That is to say, the second feeding unit 35 is configured such that a state where the first driving roller 36*a* and the first driven roller 36*b* approach to each other and a state where the first driving roller 36*a* and the first driven roller 36*b* recede from each other can be switchable. In the embodiment, the first driving roller 36*a* and the first driven roller 36*b* are provided such that the first driven roller 36*b* can move to approach to or recede from the first driving roller 36*a*.

It is needless to say that a configuration in which the first driving roller 36*a* moves to approach to or recede from the first driven roller 36*b* may be employed. However, the configuration in which the first driven roller 36*b* moves to approach to or recede from the first driving roller 36*a* is employed in the embodiment for the following reason. That is, the configuration in which the rotationally driven member can move is realized more easily in comparison with the configuration in which the driving member can move in consideration of the driving force transmission mechanism to the first driving roller 36*a*.

Further, as the first approaching/receding unit 37 which is a unit for causing the first driven roller 36*b* to approach to or recede from the first driving roller 36*a*, a structure which transmits a driving force by a cam mechanism or a gear mechanism can be exemplified.

When the plain paper P1 is fed from the first feeding unit 26 to the second feeding unit 35, a so-called skew removal operation is executed. The skew removal operation is an operation for adjusting the posture of the plain paper P1 with respect to the feeding direction.

The skew removal operation may be a so-called "bite and discharge method" or "push and abut method."

The "bite and discharge method" is a method as follows. That is, the first roller pair 36 as the second feeding unit 35 nips a tip of the plain paper P1 once. Then, the first roller pair 36 is reversely rotated so as to reversely feed the tip of the plain paper P1 to the upstream side in the feeding direction. Thereafter, the plain paper P1 is made to bow between the feeding roller 27 as the first feeding unit 26 and the first roller pair 36 as the second feeding unit 35 while the tip of the plain paper P1 is pushed to the nip line of the first roller pair 36. With this, the posture of the tip of the plain paper P1 is made to be along the nip line.

That is to say, in the "bite and discharge method", the tip of the plain paper P1 is made to be bitten by the first roller pair 36 once. Thereafter, the tip of the plain paper P1 is discharged to the upstream side in the feeding direction so that the plain paper P1 is made to bow. With this, the posture of the tip of the plain paper P1 is made to be along the nip line.

The "nip line" indicates a line formed by a portion where the first roller pair 36 is circumscribed. That is, the "nip line" is a line formed by a portion where the first roller pair 36 nips the plain paper P1 in a pressurized manner.

On the other hand, the "push and abut method" is a method as follows. That is, the plain paper P1 is fed to the downstream side in the feeding direction by the feeding roller 27. Then, the tip of the plain paper P1 is pushed to the nip line of the first roller pair 36 in a state where the first roller pair 36 stops or reversely drives. With this, the posture of the tip of the plain paper P1 is made to be along the nip line. That is, the "push and abut method" is a method in which the tip of the plain paper P1 is pushed to the first roller pair 36 so as to make the posture of the tip of the plain paper P1 be along the nip line. It is to be noted that the plain paper P1 may be made to bow between the feeding roller 27 and the first roller pair 36 to make the posture of the tip thereof be along the nip line. Alternatively, the plain paper P1 may not be made to bow therebetween to make the posture of the tip thereof be along the nip line.

Accordingly, in the case of the plain paper P1, even when the posture of the plain paper P1 is inclined with respect to the feeding direction, the plain paper P1 can be fed to the recording portion 30 after adjusting the posture thereof.

Further, the recording portion 30 is configured to execute recording onto a fed medium such as the plain paper or the like (P1 through P3). To be more specific, the recording portion 30 has a recording head 31 and a medium supporting portion 34.

The recording head 31 is provided so as to execute recording by discharging ink droplets from a nozzle row 32. Further, the medium supporting portion 34 is provided at a position opposed to the recording head 31. Then, the medium such as the plain paper and the like (P1 through P3) is supported from a lower side in the vertical direction. Therefore, a predetermined space can be kept between the recording head 31 and the medium such as the plain paper and the like (P1 through P3).

It is to be noted that a space between the recording head 31 and the medium supporting portion 34 in the Z-axis direction can be adjusted depending on types such as a material, thickness and the like of the medium (P1 through P3) to be fed on the recording portion 30. In other words, the recording head 31 and the medium supporting portion 34 are configured so as to be relatively displaced. The displacement can be performed manually or automatically.

The direction of the Z-axis corresponds to a direction in which the recording head 31 and the medium (P1 through P3) are opposed to each other.

A configuration in which the recording head 31 is displaced with respect to the medium supporting portion 34 may be employed. Alternatively, a configuration in which the medium supporting portion 34 is displaced with respect to the recording head 31 may be also employed. This prevents the medium (P1 through P3) to be fed from making contact with the recording head 31. Therefore, the recording head 31 can be prevented from being damaged or soiled and the medium (P1 through P3) can be prevented from being damaged or soiled.

Further, the third feeding unit 38 is provided at the downstream side with respect to the recording portion 30 in the feeding direction at the time of recording so as to further feed the recorded medium (P1 through P3) to the downstream side in the feeding direction. To be more specific, the third feeding unit 38 has a second roller pair 39 as in the above-described second feeding unit 35. The second roller pair 39 includes a second driving roller 39*a* which drives with a driving force of the second motor 41 and a second driven roller 39*b* which rotates following the second driving roller 39*a*.

Further, the third feeding unit 38 is configured such that the second driving roller 39*a* and the second driven roller 39*b* relatively move to approach to or recede from each other by a second approaching/receding unit 40 as will be described later in detail. The second approaching/receding unit 40 has the same configuration as that of the first approaching/receding unit 37. That is to say, a state where the second driving roller 39*a* and the second driven roller 39*b* approach to each other and a state where the second driving roller 39*a* and the second driven roller 39*b* recede from each other can be switchable. In the embodiment, the second driving roller 39*a* and the second driven roller 39*b* are provided such that the second driven roller 39*b* can move to approach to or recede from the second driving roller 39*a*.

Further, the first discharge portion 6 is provided so as to receive and laminate the plain paper P1 when the plain paper P1 onto which recording has been performed on the recording portion 30 is fed to the downstream side in the feeding direction by the third feeding unit 38 and discharged. To be more specific, the first discharge portion 6 has the first tray 7 which is provided at a lower side in the vertical direction and at a downstream side in the feeding direction at the time of recording with respect to the third feeding unit 38. Accordingly, the plain papers P1 which have been continuously discharged can be laminated on the first tray 7.

As described above, when the medium is the plain paper P1, the plain paper P1 is guided to the first feeding path R1. The first feeding path R1 is a path from the first placement portion 22 to the first discharge portion 6.

Note that in FIG. 3, the second discharge portion 9 is not shown for ease of understanding. The second tray 10 as the second discharge portion 9 is located at such a position not to hinder the plain paper P1 from being discharged onto the first tray.

In the Case of Board Paper, CD-R Tray or the Like (Second-Class Medium)

Next, a case where the medium is a board paper, a CD-R tray, or the like (second-class medium) is described.

Figure 4:
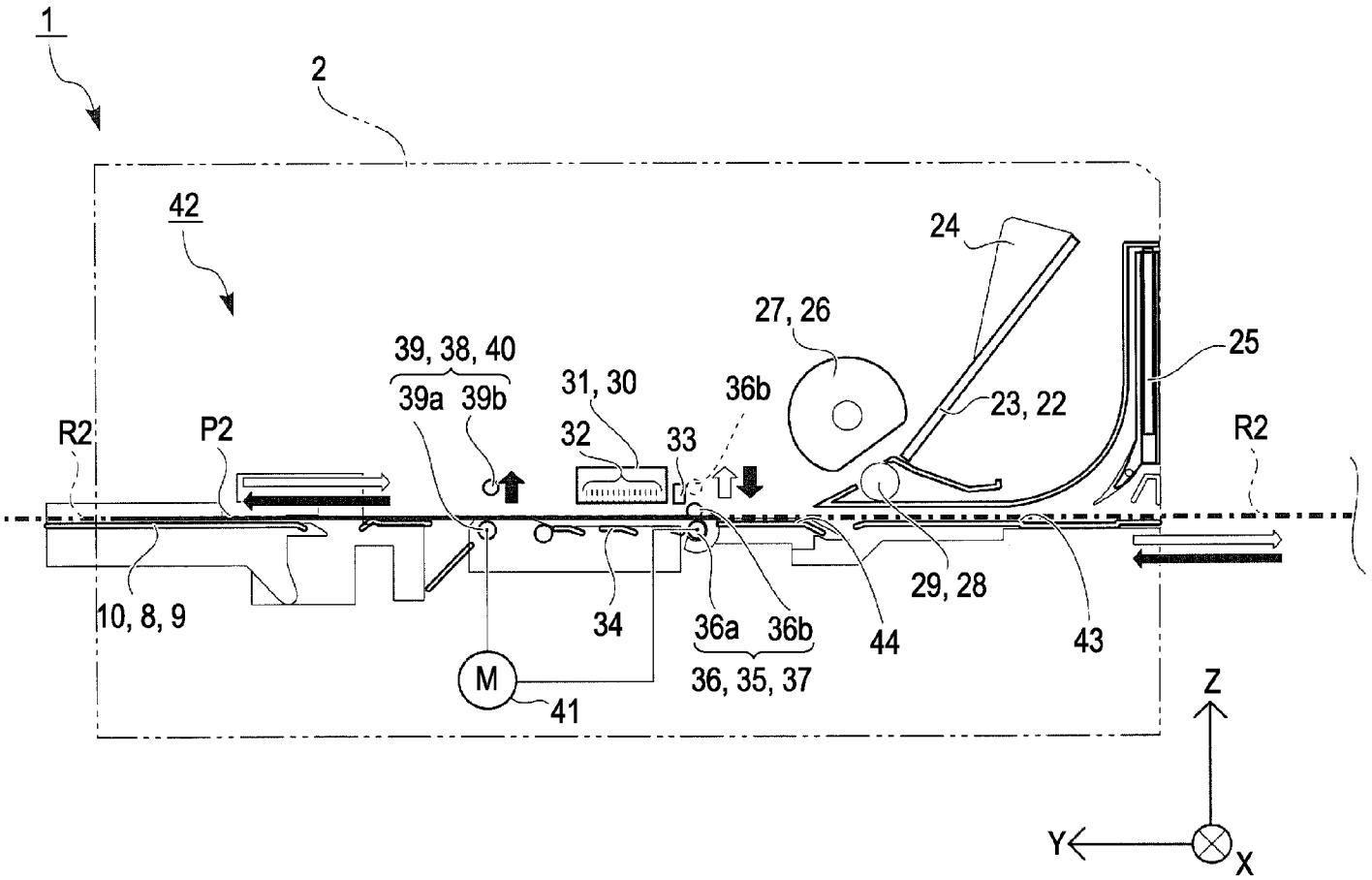
FIG. 4 is a schematic side view illustrating an inner portion of the printer according to the invention (when a second-class medium is transported).

FIG. 4 is a schematic side view illustrating an inner portion of the printer when the board paper, the CD-R tray, or the like is transported and recording is performed thereon.

As shown in FIG. 4, in a state where the movable guide member 25 is closed, an upper surface of the second tray 10, an upper surface of the medium supporting portion 34, an upper surface of the second guide portion 44 and an upper surface of the first guide portion 43 form a straight line when viewed from the side.

Further, the upper surface of the second tray 10, the upper surface of the medium supporting portion 34, the upper surface of the second guide portion 44 and the upper surface of the first guide portion 43 form a second feeding path R2 as a feeding path on which the board paper, the CD-R tray or the like P2 is fed. That is, the second feeding path R2 is formed into a straight line when viewed from the side. The reason for this is as follows. When the medium is the board paper, the CD-R tray or the like P2, the medium cannot be fed on the first feeding path (R1) which is curved when viewed from the side, because the medium is a rigid body or has high elasticity. Therefore, the second feeding path R2 which is formed into a straight line when viewed from the side is required to be provided separately from the first feeding path R1.

It is to be noted that in a case of the three-class medium (P3) which will be described later, the medium can be also fed on the second feeding path (R2) as in the second-class medium (P2).

To be more specific, when the medium is the board paper, the CD-R tray or the like P2, the user places the board paper, the CD-R tray or the like P2 on the second tray 10 which is the second placement portion 8 at the front side of the printer 1. At this time, when the type of a medium is set by the operation portion 3, the first roller pair 36 is made to be into the receding state by the first approaching/receding unit 37. In the same manner, the second roller pair 39 is made to be into the receding state by the second approaching/receding unit 40. Then, the user adjusts the medium at a predetermined position depending on the types of the medium on the second tray.

The expression "predetermined position" indicates a position where a part of the medium (P2, P3) is located between the first driving roller 36*a* and the first driven roller 36*b* of the first roller pair 36.

Thereafter, when the user operates the operation portion 3, a signal directing to start recording is sent to the controller. Thus, the first roller pair 36 is switched to the approaching state. Accordingly, the medium (P2, P3) is nipped by the first roller pair 36.

A first sensor 33 is provided between the first roller pair 36 and the recording head 31. The first sensor 33 can detect presence or absence of the medium (P2, P3). Accordingly, the printer 1 can judge that the medium (P2, P3) is set. Based on the judgment, the controller switches the first roller pair 36 to be in the approaching state. If it is judged that the medium (P2, P3) is not set, an error may be displayed.

Note that the second roller pair 39 is kept in the receding state in order to improve accuracy of feeding the medium (P2, P3) by the first roller pair 36. It is needless to say that the second roller pair 39 may be switched to the approaching state in the same manner as the first roller pair 36. In such a case, it is sufficient that the "predetermined position" is a position where a part of the medium (P2, P3) is located between the second driving roller 39*a* and the second driven roller 39*b* of the second roller pair 39.

Then, the medium (P2, P3) nipped by the first roller pair 36 is fed to the upstream side in the feeding direction at the time of the recording until the first sensor 33 does not detect the presence of the medium (P2, P3). At this time, the medium (P2, P3) moves to the upstream side in the feeding direction at the time of the recording on the second feeding path (R2) while being guided by the second tray 10, the medium supporting portion 34, the second guide portion 44 and the first guide portion 43.

When the medium (P2, P3) is long, the upstream side of the medium (P2, P3) in the feeding direction at the time of the recording can protrude to the outer side of the housing 2 while being guided by the first guide portion 43. That is to say, the upstream side of the medium (P2, P3) can protrude to the rear side of the printer 1.

The printer 1 can grasp a position of the edge of the medium (P2, P3) on the downstream side in the feeding direction at the time of the recording by grasping a timing at which the first sensor 33 does not detect the presence of the medium (P2, P3). That is, the printer 1 can grasp a position of the tip of the medium (P2, P3) at the time of the recording. Then, the first roller pair 36 is driven based on the position of the tip of the medium (P2, P3). This makes it possible to adjust the position of the tip of the medium (P2, P3) at the time of the recording to a reference position when the recording is started. The so-called fitting of the tip of the paper is completed.

At this time, the medium (P2, P3) is kept to be nipped by the first roller pair 36.

Thereafter, the medium (P2, P3) is fed to the downstream side in the feeding direction at the time of the recording by the first roller pair 36 and recording is performed onto the medium (P2, P3) on the recording portion 30. When the recording is completed, the medium (P2, P3) is further fed to the downstream side in the feeding direction at the time of the recording by the first roller pair 36 and is discharged to the second tray 10. That is to say, the medium (P2, P3) is discharged to a position which is substantially the same as the position on which a user sets the medium (P2, P3).

The following configuration may be employed. That is, if the type of the medium (P2, P3) is set by the operation portion 3, the second tray 10 moves to a position which is on the downstream side with respect to the third feeding unit 38 in the feeding direction at the time of the recording and of which height is the same as that of the third feeding unit 38 in the vertical direction Z. At this time, the position of the second tray 10 may be moved with a driving force of a motor (not shown) or may be switched manually.

Further, if the second tray 10 does not hinder the plain paper P1 from being discharged, the second tray 10 may be provided at a position which is the same as that in the case of the plain paper P1 as long as the height of the upper surface of the second tray 10 is the same as that of the upper surface of the medium supporting portion 34 in the vertical direction Z. In such a case, the second tray 10 may move to a position as shown in FIG. 4 in conjunction with the operation in which the second cover member 5 is opened to the front side.

Further, the controller is configured to judge whether the movable guide member 25 is in a closed state as shown in FIG. 4 by using a second sensor (not shown). The controller is configured in such manner for judging whether the second feeding path R2 on which the board paper, the CD-R tray or the like P2 is fed is in the opened state at the rear side of the printer 1.

When the movable guide member 25 is opened, a direction is indicated for a user to make the movable guide member 25 be in the closed state. For example, such direction may be displayed on a display device such as a liquid crystal panel provided on the operation portion 3 or a warning sound may be generated.

In the Case of Dedicated Paper (Third-Class Medium)

Subsequently, a case where the medium is a dedicated paper (third-class medium) is described.

Figure 5:
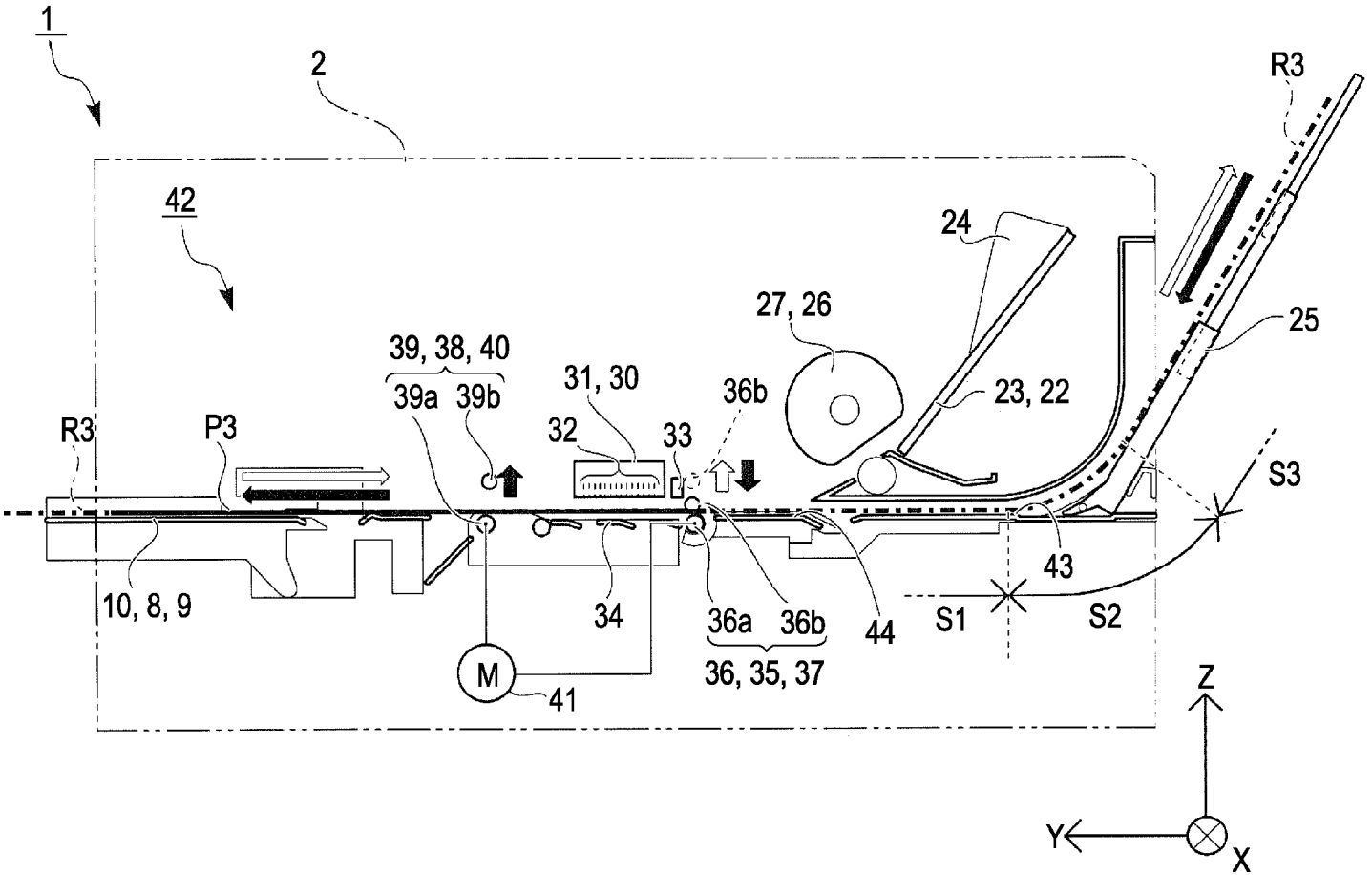
FIG. 5 is a schematic side view illustrating an inner portion of the printer according to the invention (when a third-class medium is transported).

FIG. 5 is a schematic side view illustrating an inner portion of the printer when the dedicated paper is transported and recording is performed thereon.

As shown in FIG. 5, in a state where the movable guide member 25 is opened, a first linear zone S1 is formed of the upper surface of the second tray 10, the upper surface of the medium supporting portion 34, the upper surface of the second guide portion 44 and the upper surface of the first guide portion 43. Further, a curved zone S2 which is curved when viewed from the side is formed of the upper surface of the first guide portion 43 on the upstream side in the feeding direction at the time of the recording and the movable guide member 25 on a swing fulcrum side. In addition, a second linear zone S3 is formed of the movable guide member 25 on a free end side.

Then, a third feeding path R3 as a feeding path on which the dedicated paper P3 is fed is formed of the first linear zone S1, the curved zone S2 which is curved when viewed from the side and the second linear zone S3. That is, the third feeding path R3 is formed so as to have the curved zone S2 which is curved when viewed from the side at the rear side of the printer 1. The reason for this is that the posture of the dedicated paper P3 on the upstream side in the feeding direction at the time of the recording can be bent in the curved zone S2. To be more specific, the posture of the dedicated paper P3 can be bent in the curved zone S2 when the dedicated paper P3 which is a medium having flexibility is placed on the second placement portion 8 as in the same manner as the board paper, the CD-R tray or the like P2, and is fed to the upstream side in the feeding direction at the time of the recording at a stage before recording.

With this configuration, the length of protrusion of the medium (P3) to the rear side of the printer 1 can be made shorter than that when the second feeding path R2 is used. Accordingly, even when a barrier such as a wall of a room is present near the rear of the printer 1, a risk that the medium (P3) protruding to the rear side of the printer 1 makes contact with the barrier at a stage before the recording can be substantially eliminated. As a result, in the case of the dedicated paper P3, a sufficiently large space required when the second feeding path R2 is used is not required to be ensured at the rear side of the printer 1 by using not the second feeding path R2 but the third feeding path R3.

That is to say, in the case of the dedicated paper P3, time and effort of a user for moving the printer 1 to the front side for ensuring the sufficiently large space at the rear side of the printer 1 can be eliminated.

It is to be noted that the dedicated paper P3 has high elasticity and friction resistance and the like generated between the dedicated paper P3 and the feeding path is large in comparison with the plain paper P1. Therefore, it is difficult to apply a sufficient feeding force to the dedicated paper P3 with the feeding roller 27 and the dedicated paper P3 cannot be fed on the first feeding path R1 unlike the plain paper P1.

For these reasons, the dedicated paper P3 is placed on the second placement portion 8 as in the same manner as the board paper, the CD-R tray or the like P2. Then, the dedicated paper P3 is nipped by the first roller pair 36 so as to be fed to the upstream side or the downstream side in the feeding direction at the time of the recording.

The first roller pair 36 nips the medium (P3) firmly so as to apply a feeding force larger than that by the feeding roller 27 to the medium (P3).

The dedicated paper P3 cannot be fed on the first feeding path R1 unlike the plain paper P1. However, the dedicated paper P3 is a medium having flexibility and low elasticity in comparison with the board paper, the CD-R tray or the like P2.

Thereafter, as in the case of the board paper, the CD-R tray or the like P2 as described above, the dedicated paper P3 nipped by the first roller pair 36 is fed to the upstream side in the feeding direction at the time of the recording until the first sensor 33 does not detect the presence of the dedicated paper P3. At this time, the dedicated paper P3 moves to the upstream side in the feeding direction at the time of the recording on the third feeding path (R3) while being guided by the second tray 10, the medium supporting portion 34, the second guide portion 44, the first guide portion 43 and the movable guide member 25.

The printer 1 can grasp a position of the edge of the dedicated paper P3 on the downstream side in the feeding direction at the time of the recording by grasping a timing at which the first sensor 33 does not detect the presence of the dedicated paper P3. That is, the printer 1 can grasp a position of the tip of the dedicated paper P3 at the time of the recording. Then, the first roller pair 36 is driven based on the position of the tip of the dedicated paper P3. This makes it possible to adjust the position of the tip of the dedicated paper P3 at the time of the recording to a reference position when the recording is started. The so-called fitting of the tip of the paper is completed.

At this time, the dedicated paper P3 is kept to be nipped by the first roller pair 36.

Thereafter, the dedicated paper P3 is fed to the downstream side in the feeding direction at the time of the recording by the first roller pair 36 and recording is performed onto the dedicated paper P3 on the recording portion 30. When the recording is completed, the dedicated paper P3 is further fed to the downstream side in the feeding direction at the time of the recording by the first roller pair 36 and is discharged to the second tray 10. That is to say, the dedicated paper P3 is discharged to a position which is substantially the same as the position on which a user sets the medium P3.

Next, an adjustment unit 13 according to the invention is described.

Figure 6:
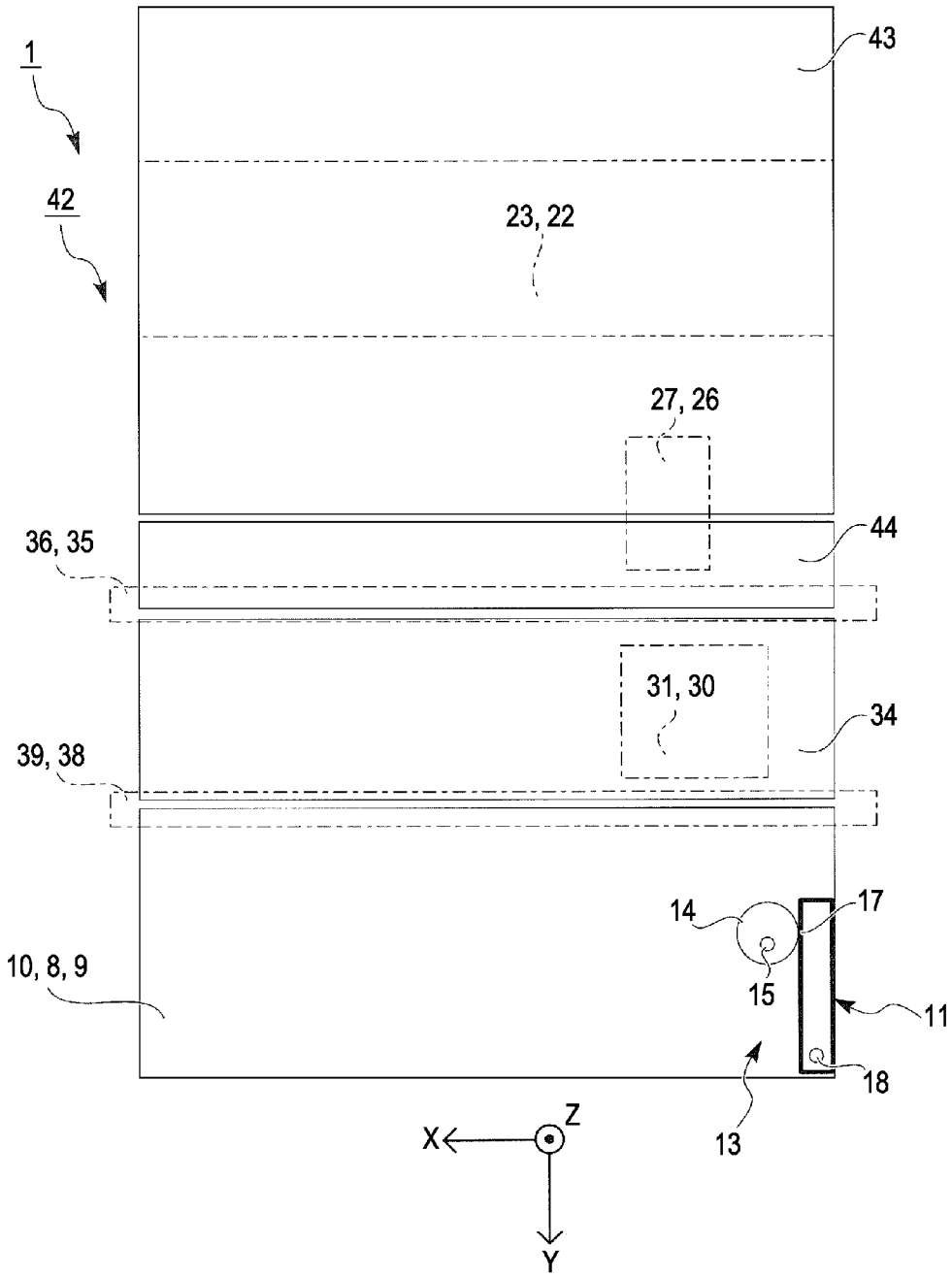
FIG. 6 is a schematic plan view illustrating an inner portion of the printer according to the invention.

FIG. 6 is a schematic plan view illustrating an inner portion of the printer according to the invention. As shown in FIG. 6, a second edge guide 11 is provided on the second tray 10 as the second placement portion 8 at one edge side in the width direction X. The second edge guide 11 is provided so as to make contact with the side edge of the medium of the dedicated paper P3 or the board paper, the CD-R tray or the like P2 set on the second tray 10. Therefore, the second edge guide 11 can determine a position of the medium (P2, P3) in the width direction X and a posture of the medium (P2, P3) with respect to the feeding direction.

Further, the adjustment unit 13 which adjusts the posture of the medium (P2, P3) with respect to the feeding direction is provided on the second tray 10.

To be more specific, the adjustment unit 13 can adjust the posture of the second edge guide 11. The posture of the medium (P2, P3) is adjusted by adjusting the posture of the second edge guide 11. The adjustment unit 13 according to the embodiment has an eccentric cam portion 14, and a cam follower portion 17 as an example of a configuration.

The eccentric cam portion 14 is provided so as to be rotatable about a first fulcrum shaft 15 on the second tray 10.

On the other hand, the cam follower portion 17 is provided on the second edge guide 11 so as to make contact with the eccentric cam portion 14. Then, the eccentric cam portion 14 operates so that the second edge guide 11 swings about a second fulcrum shaft 18. Hereinafter, the adjustment unit 13 is described in more detail.

Figure 7:
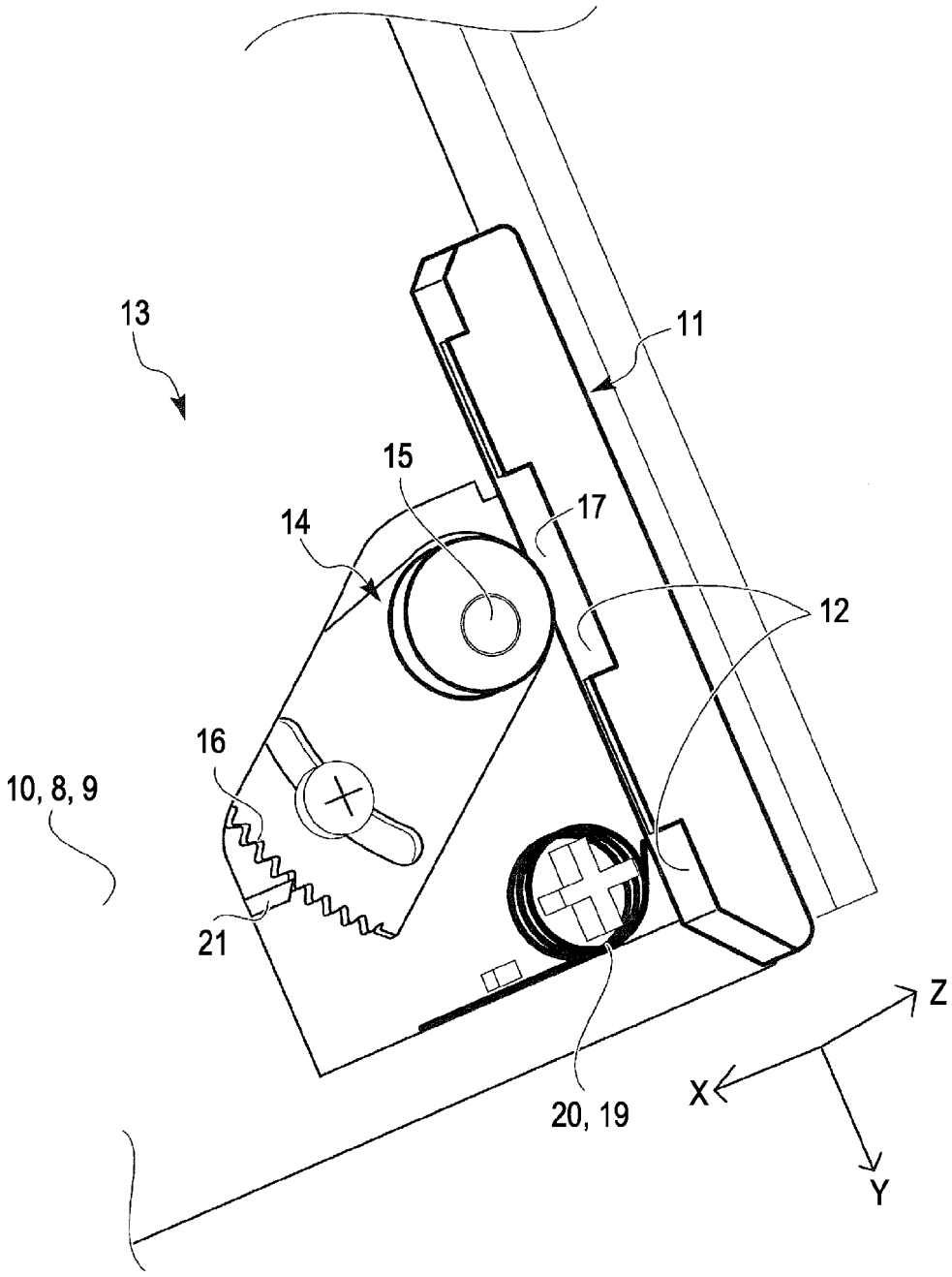
FIG. 7 is an enlarged perspective view illustrating a main part of an adjustment unit according to the invention.
Figure 8:
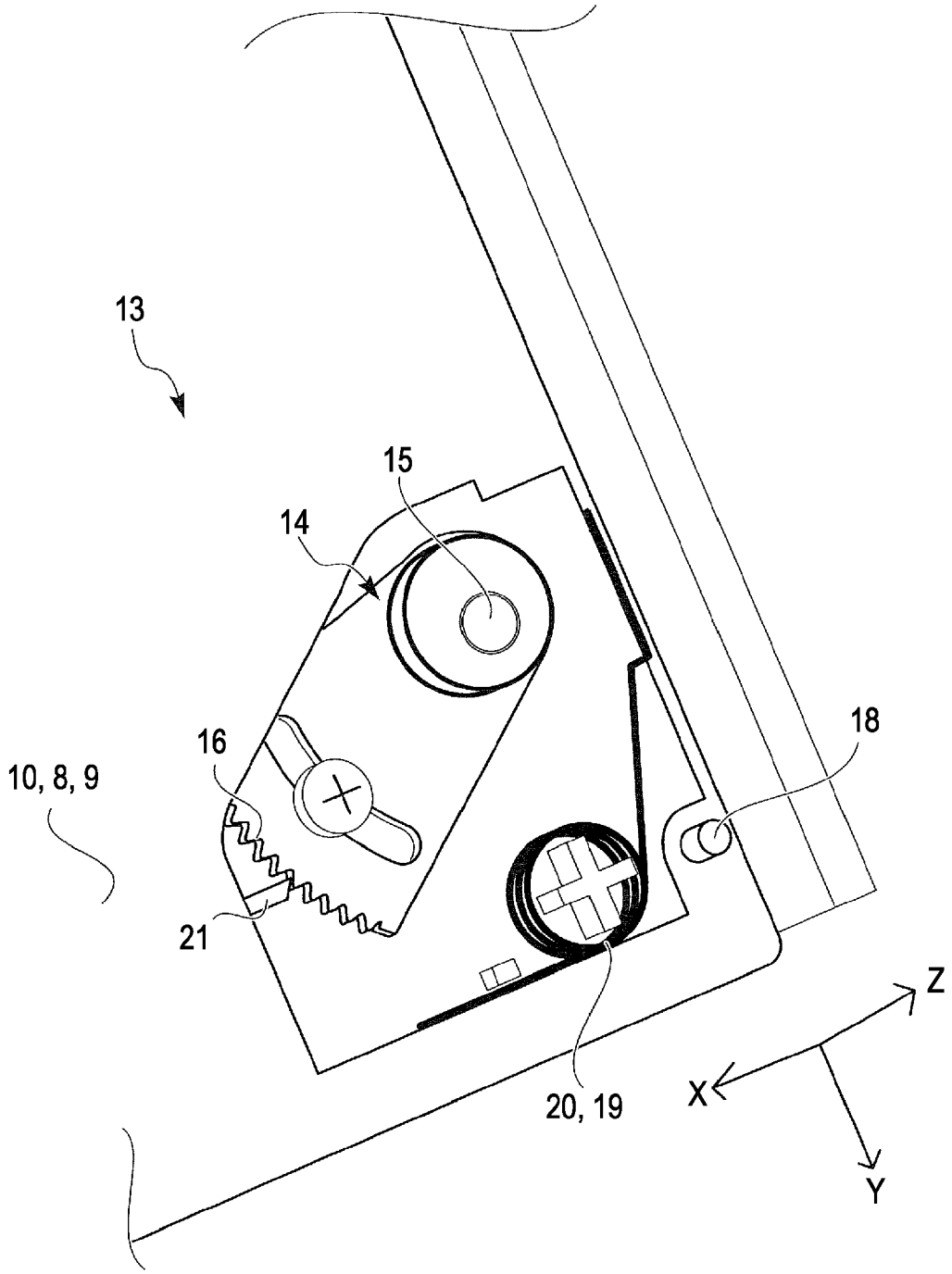
FIG. 8 is an enlarged perspective view illustrating the main part of the adjustment unit according to the invention.
Figure 9:
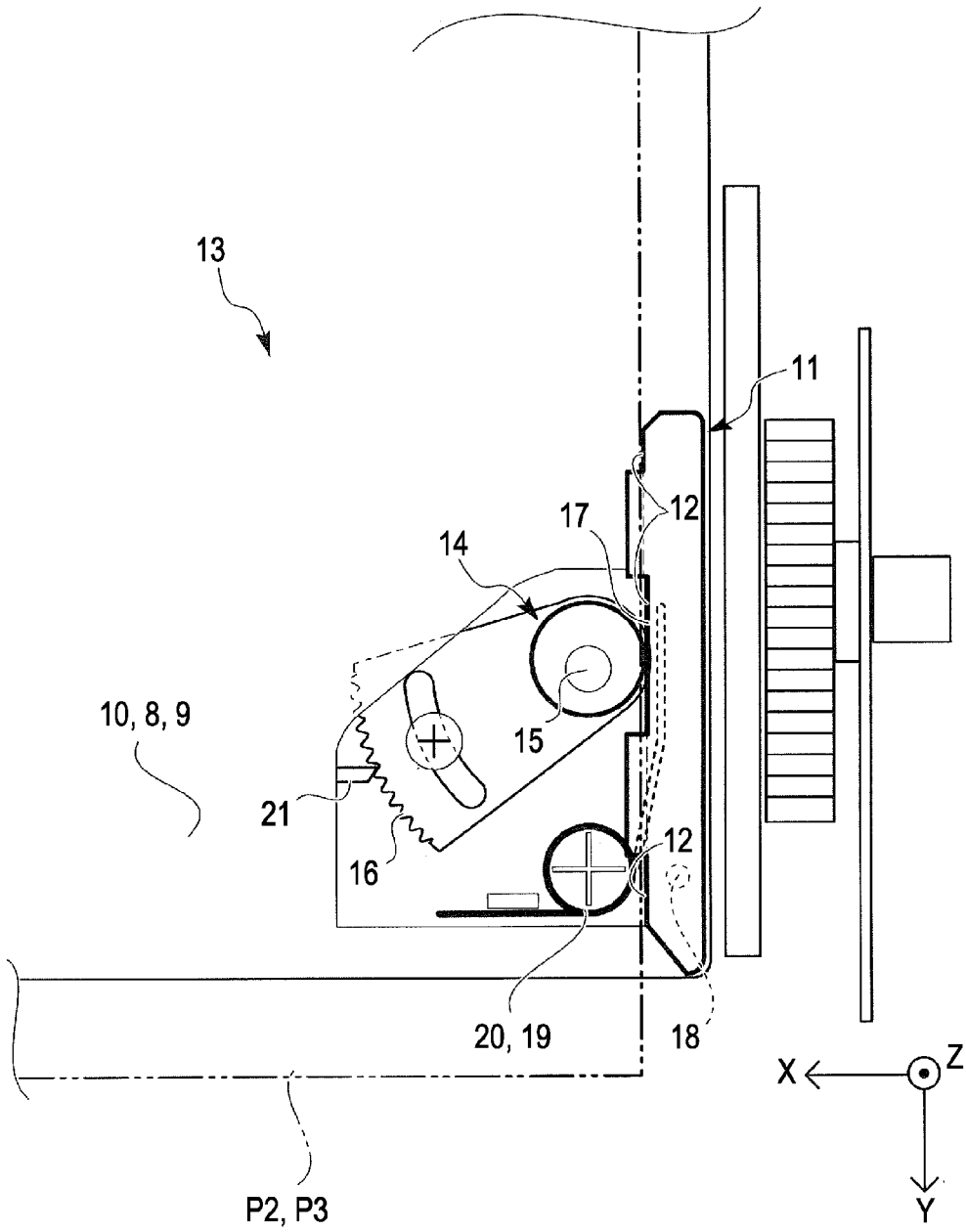
FIG. 9 is an enlarged plan view illustrating the main part of the adjustment unit according to the invention.
Figure 10:
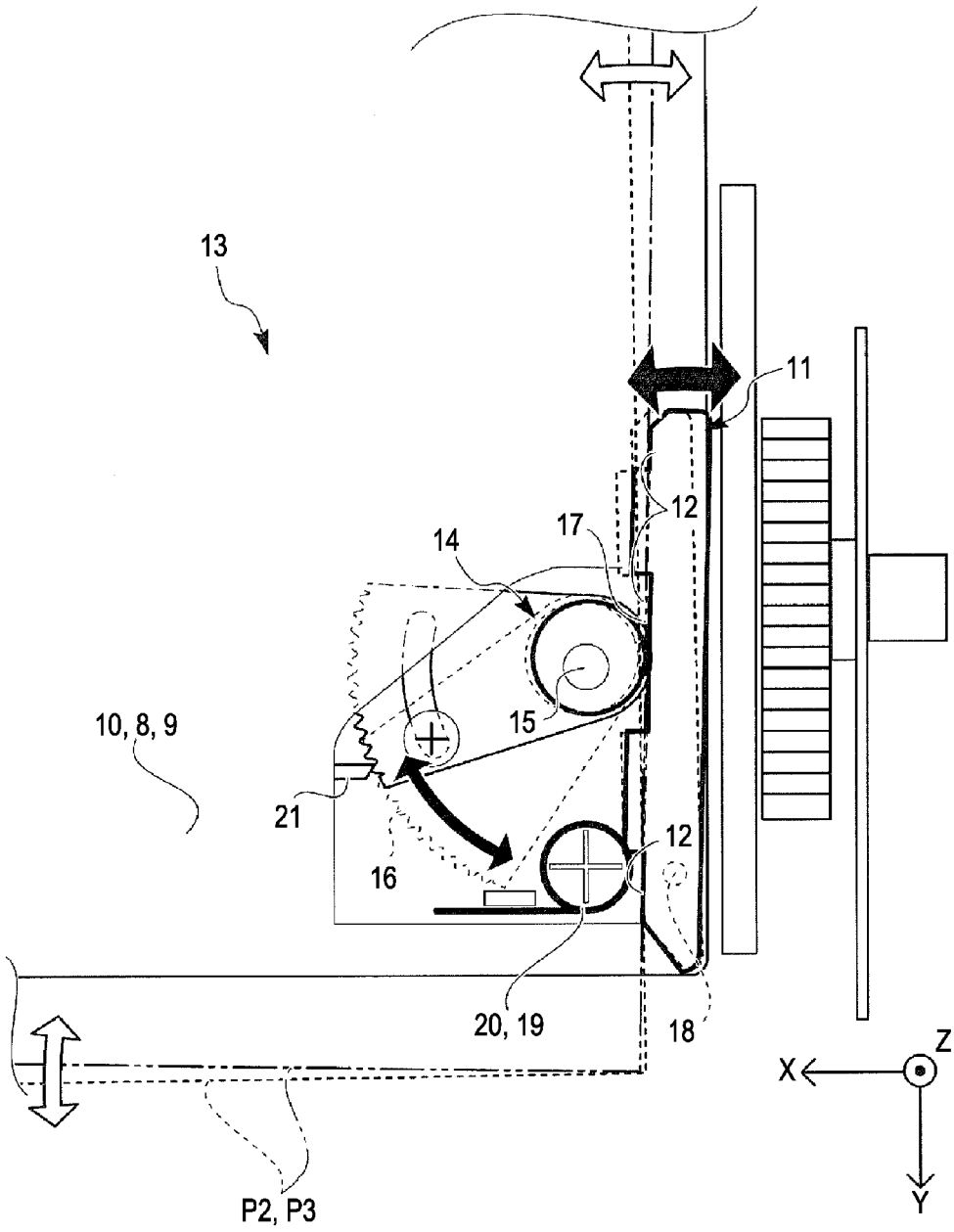
FIG. 10 is an enlarged plan view illustrating the main part of the adjustment unit according to the invention.

FIG. 7 is an enlarged perspective view illustrating a main portion of the adjustment unit according to the invention. FIG. 8 is an enlarged perspective view illustrating the main portion of the adjustment unit according to the invention. Note that the second edge guide shown in FIG. 7 is not shown in FIG. 8 for ease of understanding. FIG. 9 is an enlarged plan view illustrating the main portion of the adjustment unit according to the invention. FIG. 10 is an enlarged perspective view illustrating the main portion of the adjustment unit according to the invention. Further, FIG. 10 illustrates a state where the posture of the medium is adjusted.

As shown in FIG. 7 through FIG. 10, the eccentric cam portion 14 is provided so as to be rotatable about the first fulcrum shaft 15. The eccentric cam portion 14 is eccentric with respect to the first fulcrum shaft 15. Further, a tooth-shaped jagged portion 16 is formed on a free end of the eccentric cam portion 14. A part of the jagged portion 16 is configured so as to engage with a claw portion 21 formed on the second tray 10. That is, a part of the jagged portion 16 is made to engage with the claw portion 21 by changing the posture of the eccentric cam portion 14 in a stepwise manner. This makes it possible to make the posture of the eccentric cam portion 14 stable. Further, the eccentric cam portion 14 in the engaged state can be fixed with a screw.

Further, the second edge guide 11 is biased in the direction of approaching to the eccentric cam portion 14 with a spring 20 as an example of a biasing unit 19. Accordingly, the cam follower portion 17 formed on the second edge guide 11 is in contact with the eccentric cam portion 14 all the time. Thus, the posture of the second edge guide 11 can be changed by rotating the eccentric cam portion 14 to change the posture of the eccentric cam portion 14.

As a result, the posture of a guide surface 12 of the second edge guide 11 can be adjusted so as to be perpendicular to the posture of the first roller pair 36. The guide surface 12 is a surface which makes contact with the medium (P2, P3). To be more specific, the medium (P2, P3) is set on the second tray 10 and one side edge of the medium (P2, P3) is aligned to the guide surface 12. Then, the operation portion 3 is operated so as to select a mode in which a predetermined test pattern is recorded and press an execution button.

The expression "test pattern" is a pattern formed of lines parallel with and perpendicular to the feeding direction. The inclination degree of the posture of the medium (P2, P3) with respect to the feeding direction can be judged based on the test pattern.

With the operation, the predetermined test pattern is recorded on the medium (P2, P3) while being guided by the above-described second feeding path R2 or the third feeding path R3. Then, the medium (P2, P3) is discharged to the second tray 10. Next, the user looses the screw and rotates the eccentric cam portion 14 based on the test pattern visually recognized so as to slightly swing the posture of the second edge guide 11 about the second fulcrum shaft 18 disposed in the Z-axis direction. Thus, the inclination of the posture of the medium (P2, P3) with respect to the feeding direction when the medium (P2, P3) is set on the second tray 10 can be substantially eliminated.

The posture of the guide surface 12 of the second edge guide 11 tends to be inclined with respect to the feeding direction due to production tolerance or the like in the following cases. That is, in a case where the configuration of the second placement portion 8 is complicated or a case where the number of parts of the second placement portion 8 is large, the posture of the guide surface 12 tends to be inclined. Therefore, the adjustment unit 13 is particularly effective in these cases. Further, when the medium (P2, P3) is set on the second placement portion 8, the skew removal operation is not executed or cannot be executed as described above. The adjustment unit 13 is also particularly effective in such a case.

It is to be noted that although the eccentric cam portion 14 is rotated so as to adjust the posture of the second edge guide 11 manually in the embodiment, the posture of the second edge guide 11 may be automatically adjusted. For example, a configuration in which a user inputs information about the degree of the inclination of the medium (P2, P3) based on the test pattern on the operation portion 3 may be employed. Then, the eccentric cam portion 14 may be made to rotate automatically with a driving force of a motor (not shown) based on the input information. Further, it is needless to say that a configuration in which a reading portion which can recognize the test pattern is provided and the eccentric cam portion 14 is rotated automatically based on the read information may be employed.

Further, the adjustment unit 13 adjusts the posture of the medium (P2, P3) placed on the second placement portion 8 in the embodiment. However, it is needless to say that the adjustment unit 13 may adjust the posture of the medium (P1) placed on the first placement portion 22. In such a case, the posture of the plain paper P1 with respect to the feeding direction can be adjusted by adjusting the posture of the first edge guide 24. As a result, accuracy of the posture of the plain paper P1 at the time of the recording can be improved.

In addition, the adjustment unit 13 adjusts the posture of the medium at the one edge side in the width direction on the second placement portion 8 in the embodiment. However, it is needless to say that the adjustment unit 13 may adjust the posture of the medium at the both edge sides.

The posture of the medium is adjusted at only one side edge in the embodiment because the posture of the medium can be adjusted more easily when the adjusting is carried out at only one side in comparison with the case where the posture of the medium is adjusted at the both edge sides.

Further, in the embodiment, the upstream side of the second edge guide 11 is made to swing in the width direction X about the downstream side thereof as a fulcrum in the feeding direction at the time of the recording. However, it is needless to say that the downstream side of the second edge guide 11 may be made to swing about the upstream side thereof as a fulcrum. The same operation effect can be obtained with such configuration.

The medium feeding apparatus 42 according to the embodiment includes the second placement portion 8, the second feeding unit 35, the second edge guide 11 and the adjustment unit 13. The second placement portion 8 is a placement portion on which the board paper or the CD-R tray P2 (second-class medium) and the dedicated paper P3 (third-class medium), which are examples of fed media, are placed. The second feeding unit 35 is a feeding unit which feeds the board paper or the CD-R tray P2 (second-class medium) and the dedicated paper P3 (third-class medium) placed on the second placement portion 8 in the feeding direction. The second edge guide 11 is an edge guide which makes contact with the board paper or the CD-R tray P2 (second-class medium) and the dedicated paper P3 (third-class medium) placed on the second placement portion 8 at a side edge thereof in the width direction so as to position the board paper or the CD-R tray P2 (second-class medium) and the dedicated paper P3 (third-class medium) in the width direction X. The adjustment unit 13 is a unit which displaces at least a part of the second edge guide 11 so as to adjust the posture of the board paper or the CD-R tray P2 (second-class medium) and the dedicated paper P3 (third-class medium) with respect to the feeding direction.

Further, in the embodiment, the adjustment unit 13 is configured such that one of the upstream side and the downstream side of the second edge guide 11 in the feeding direction can swing in the width direction X about the second fulcrum shaft 18 prepared in the other of the upstream side and the downstream side. The width direction X is the approaching/receding direction with respect to the side edge of the board paper or the CD-R tray P2 (second-class medium) and the dedicated paper P3 (third-class medium).

In addition, in the embodiment, the adjustment unit 13 has the eccentric cam portion 14 and the cam follower portion 17. The eccentric cam portion 14 is an eccentric cam. The cam follower portion 17 is a cam follower which abuts against the eccentric cam portion 14. The cam follower portion 17 is provided on the second edge guide 11.

The printer 1 which is the recording apparatus according to the embodiment includes the medium feeding apparatus 42 and the recording portion 30. The medium feeding apparatus 42 is a medium feeding unit which feeds the board paper or the CD-R tray P2 (second-class medium) and the dedicated paper P3 (third-class medium), which are examples of the recording media, to the downstream side in the feeding direction. The recording portion 30 executes recording onto the board paper or the CD-R tray P2 (second-class medium) and the dedicated paper P3 (third-class medium) fed by the medium feeding apparatus 42 by the recording head 31.

Further, in the embodiment, the second feeding unit 35 is the first roller pair 36 including the first driving roller 36*a* as a feeding driving roller and the first driven roller 36*b* as a feeding driven roller. The first driving roller 36*a* drives with a driving force of the second motor 41. The first driven roller 36*b* rotates following the first driving roller 36*a*. The first roller pair 36 is provided so as to be switchable between a first state and a second state. In the first state, the first driving roller 36*a* and the first driven roller 36*b* approach to each other. In the second state, the first driving roller 36*a* and the first driven roller 36*b* recede from each other. When one of the board paper or the CD-R tray P2 (second-class medium) and the dedicated paper P3 (third-class medium) is placed, the first roller pair 36 is in the second state. Then, the first roller pair 36 is switched to the first state based on the direction to start recording so as to nip the board paper or the CD-R tray P2 (second-class medium) or the dedicated paper P3 (third-class medium). Then, the board paper or the CD-R tray P2 (second-class medium) or the dedicated paper P3 (third-class medium) is fed to the recording portion 30 while the first roller pair 36 nips the board paper or the CD-R tray P2 (second-class medium) or the dedicated paper P3 (third-class medium). Thereafter, the recording portion 30 executes recording onto the board paper or the CD-R tray P2 (second-class medium) or the dedicated paper P3 (third-class medium) nipped by the first roller pair 36.

Another Embodiment

Figure 11:
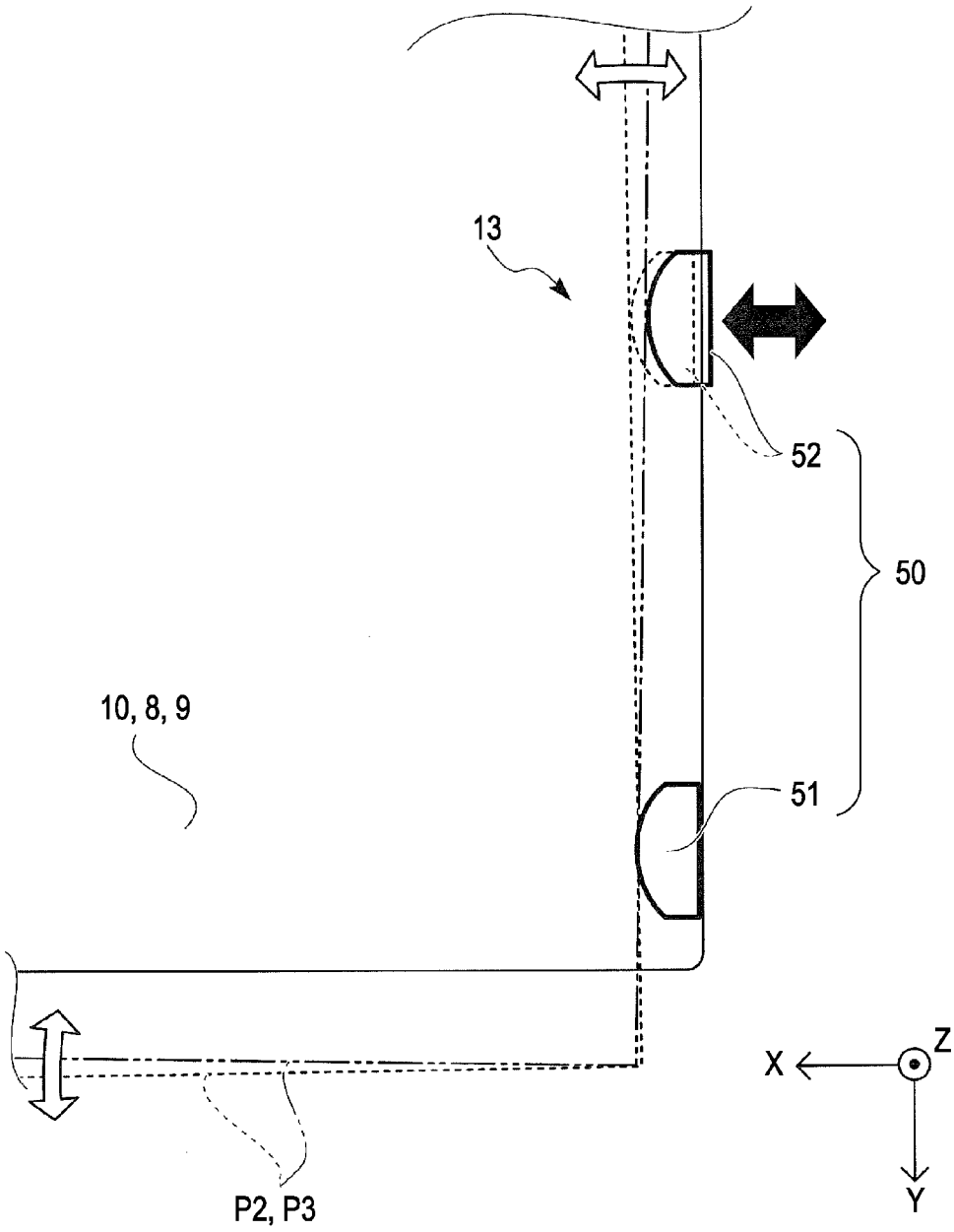
FIG. 11 is a schematic plan view illustrating an adjustment unit according to another embodiment.

FIG. 11 is a schematic plan view illustrating an adjustment unit according to another embodiment.

As shown in FIG. 11, in that another embodiment, a second edge guide 50 includes a first guide portion 51 and a second guide portion 52.

It is to be noted that since other members of the adjustment unit are the same as those in the above-described embodiment, the same reference numerals denote the same members and description is not repeated.

The first guide portion 51 is integrally formed with the second tray 10. That is, the first guide portion 51 is fixed in the width direction X. On the other hand, the second guide portion 52 is provided at a position different from that of the first guide portion 51 in the feeding direction. Further, the second guide portion 52 is configured to be displaced so as to approach to or recede from the side edge of the medium (P2, P3) in the width direction X. As a configuration for displacement, a configuration in which the eccentric cam portion 14 and the cam follower portion 17 are included as in the above-described embodiment can be exemplified.

Accordingly, as in the above-described embodiment, the inclination of the posture of the medium (P2, P3) with respect to the feeding direction when the medium (P2, P3) is set on the second tray 10 can be substantially eliminated.

In that another embodiment, the second edge guide 50 includes the first guide portion 51 and the second guide portion 52. The first guide portion 51 makes contact with a side edge of the board paper or the CD-R tray P2 (second-class medium) and the dedicated paper P3 (third-class medium). The second guide portion 52 is provided at a different position from the first guide portion 51 in the feeding direction and makes contact with the side edge of the board paper or the CD-R tray P2 (second-class medium) and the dedicated paper P3 (third-class medium). The adjustment unit 13 has a configuration in which the second guide portion 52 is displaced in the width direction X so that the second guide portion 52 is relatively displaced with respect to the first guide portion 51. The width direction X is the approaching/receding direction with respect to the side edge of the board paper or the CD-R tray P2 (second-class medium) and the dedicated paper P3 (third-class medium).

The direction in which the adjustment unit displaces at least a part of the second edge guide may be as follows. That is, it is sufficient that a portion on the second guide portion of the second edge guide which makes contact with the medium at a side edge (P2, P3) is displaced in the approaching/receding direction (X) with respect to the side edge of the medium. In other words, the second edge guide itself may be displaced in either direction.

For example, it is assumed that the contact portion on the second guide portion is an inclined surface and is gradually inclined upward to the face side in the face-reverse direction toward the outer side in the width direction.

In such a case, the contact portion can be displaced in the width direction X by displacing the second guide portion of the second edge guide in the face-reverse direction (Z-axis direction). This makes it possible to adjust the posture of the medium (P2, P3).

Further, it is needless to say that the invention is not limited to the above embodiments and various modifications can be made within the scope of the invention. Further, the modifications are encompassed within the invention.

What is claimed is:

1. A medium feeding apparatus comprising:

a placement portion on which a medium is placed, wherein the placement portion is a medium feed tray that is located downstream of a recording head of a recording apparatus that the medium feeding apparatus is part of;

a feeding unit which feeds the medium placed on the placement portion in a feeding direction;

an edge guide which makes contact with the medium placed on the placement portion at a side edge in a width direction so as to determine a position of the medium in the width direction; and an adjustment unit which displaces at least a part of the edge guide such that a contact portion of the edge guide with the medium is placed on a line along the feeding direction so as to adjust a posture of the medium with respect to the feeding direction, the adjustment unit including a cam portion, wherein a tooth-shaped jagged portion is formed on the cam portion, and wherein a part of the tooth-shaped portion is configured so as to engage with a claw portion formed on the placement portion, wherein the adjustment unit is located adjacent the edge guide on a placement portion side of the edge guide so as to be adjacent the placement portion, wherein the adjustment unit is configured such that an upstream side of the edge guide in the feeding direction is capable of swinging about a fulcrum in the width direction of the medium.

2. The medium feeding apparatus according to claim 1, wherein the adjustment unit further includes:

a cam follower which abuts against the eccentric cam portion, and the cam follower is provided on the edge guide.

3. A recording apparatus comprising:

a medium feeding unit which feeds a recording medium to a downstream side in a feeding direction; and a recording portion which records onto the recording medium fed by the medium feeding unit by the recording head, wherein the medium feeding unit includes the medium feeding apparatus according to claims 1 or 2, and the recording medium is the medium.

4. The recording apparatus according to claim 3, wherein the feeding unit is a feeding roller pair including:

a feeding driving roller which drives with a driving force of a motor; and a feeding driven roller which rotates following the feeding driving roller;

the feeding roller pair is provided so as to be switchable between a first state where the feeding driving roller and the feeding driven roller approach to each other and a second state where the feeding driving roller and the feeding driven roller recede from each other;

when the recording medium is placed, the feeding roller pair is in the second state, and the feeding roller pair is switched to the first state by a direction to execute recording so as to nip the recording medium;

the feeding roller pair feeds the recording medium to the recording portion while keeping a state where the feeding roller pair nips the recording medium; and the recording portion executes recording onto the recording medium which is being nipped by the feeding roller pair.

* * * * *